United States Patent [19]

Ruby

[11] Patent Number: 4,998,045

[45] Date of Patent: Mar. 5, 1991

[54] FLUORESCENT LAMP DIMMER

[75] Inventor: Joseph H. Ruby, Glendale, Ariz.

[73] Assignee: Honeywell Inc., Minneapolis, Minn.

[21] Appl. No.: 280,482

[22] Filed: Dec. 6, 1988

[51] Int. Cl.[5] ..... H05B 37/02; H05B 41/36; G05F 1/00

[52] U.S. Cl. ..... 315/209 R; 315/219; 315/291; 315/DIG. 4; 315/DIG. 5; 315/DIG. 7

[58] Field of Search ..... 315/DIG. 4, 291, 293, 315/294, 297, 200 R, 209 R, DIG. 5, DIG. 7, 208, 219; 363/98, 132

[56] References Cited

U.S. PATENT DOCUMENTS 4,346,332 8/1982 Walden ..... 315/DIG. 4
4,370,600 1/1983 Zansky ..... 315/DIG. 4
4,682,080 7/1987 Ogawa et al. ..... 315/DIG. 4
4,704,560 11/1987 Mills et al. ..... 315/169.3

FOREIGN PATENT DOCUMENTS 2416619 10/1979 France ..... 315/DIG. 4

*Primary Examiner*—Eugene R. Laroche
*Assistant Examiner*—Michael B. Shingleton
*Attorney, Agent, or Firm*—Kinney & Lange

[57] ABSTRACT

A fluorescent lamp dimmer, for use with one or more fluorescent lamps where large ratios of luminous differences are required, which includes apparatus for powering the arc current for the fluorescent lamps from a source of pulsating voltage of variable pulse width and variable frequency both of which can be changed by relatively small amounts and still produce very large changes (15,000:1) in luminescence.

33 Claims, 3 Drawing Sheets

FLUORESCENT LAMP DIMMER

BACKGROUND OF THE INVENTION

1. Field of the Invention.

The present invention relates to apparatus for use in dimming fluorescent lamps and, more particularly, to a high efficiency circuit having a large dimming range ratio suitable for use in applications such as flat panel displays where ambient light may change from very dim to very bright as, for example, in an aircraft environment.

2. Description of the Prior Art.

Fluorescent lamp dimming circuits for use in general area lighting are well known in the prior art. For example, co-pending applications Serial No. 39,111 entitled "Time Delay Initialization Circuit", Serial No. 239,193 entitled "Notch Cutting Circuit with Minimal Power Dissipation", and Serial No. 39,209 entitled "Power Control Circuit for Inductive Loads", all of which were filed Aug. 31, 1988, and are assigned to the assignee of the present invention, show a fluorescent lamp dimming system in which the alternating signal supplying the power to the lamp is cut with a notch of variable width so as to reduce the power applied to the lamp and thereby provide the desired dimming.

While such circuits are useful for general area lighting where the ratio between the brightest and the dimmest is not very large, in some applications there is a need for fluorescent light dimming in which the dimming ratio is desired to be greater than, for example, 10,000:1. Such an application is found in aircraft, and especially military aircraft, where display systems in the form of color liquid crystal flat panels are used. These displays need a back lighting system to make information visible to the pilot under ambient lighting conditions that may go from near blackness at night to extreme bright glare facing into the sun. Since it is also desired that the back lighting color not change over the dimming range, fluorescent lights are preferred since their color is not altered by dimming but rather by the selection of the appropriate composition of phosphorus coating within the lamp. Accordingly, the brightness of the fluorescent lamp needs to vary by a large amount in order for the pilot to be able to view the display under all ambient light conditions. It is also desirable that the change be rather exponential, because under dark conditions the variation in luminance necessary to accommodate changes in ambient light are far less than the variation in luminance necessary under very bright conditions. Accordingly, it is desired that control of the output of the fluorescent lamps vary the brightness of the lamps by a relatively small amount under dark ambient light conditions, but by a relatively large amount under bright sunlight conditions and a log or exponential response is preferred. The system should also be free of swirls, flicker and discontinuities, be capable of withstanding temperatures from about −55° C. to +75° C. with a smooth response to the pilot's dimming command, and be able to provide a large number of cold starts and hours of operation while maintaining a high circuit efficiency. In some cases, the dimmer needs to drive multiple lamps (for reliability) in parallel and, accordingly, electrical isolation is needed so that if a lamp fails it will not affect the luminance output of the remaining lamps.

While some companies have provided fluorescent backlight assemblies, to date the best dimming range is no greater than 1,000:1, the efficiency of such lamps is believed to be only around 50% and such lamps are believed to have some luminescence instabilities.

SUMMARY OF THE INVENTION

The present invention overcomes the problems in the prior art by providing a luminescent dimming range in excess of 15,000:1 with any number of parallel lamps, and does so while maintaining an efficiency of greater than 75%, freedom from undesirable swirls, flicker and discontinuities with a smooth response to dimming commands, and a minimum amount of cathode damage which enables above 10,000 cold starts and 10,000 hours of operation. Twenty-five thousand one-minute on and one-minute off start-stop cycles have been obtained with the circuit of the present invention without significant cathode damage.

The obtaining of very high dimming ratios is obtained in the present invention by varying the pulse width and frequency of the signal operable to produce the arc current in the lamp without having to vary either of these parameters more than a reasonably small amount, i.e. about 25:1. This is made possible because, in the present invention, the arc current is proportional to the square of the pulse width and inversely proportional to the period (reciprocal of frequency) of the energizing signal and, accordingly, by varying these two parameters in a small 1:25 ratio each, it is possible to obtain an overall change of arc current and thus lamp luminescence which is proportional to $25^3$ or 5,625:1. This dimming ratio is further enhanced by the fact that the impedance of a fluorescent lamp is negative and thus varies inversely with the lamp arc current so that as the other two variables are changed to increase the current, the impedance changes to further increase the current and, accordingly, obtaining ratios in the range of 16,000:1 or more with only a 25:1 change in the pulse width and period is obtainable with the present invention. Other unique features of the present invention include: (1) monitoring the filament temperature to assure a satisfactory condition exists before applying the high voltage thereto and thus reducing damage and increasing operating life; (2) sensing the arc current and reducing the filament heater current as the arc current increases to conserve power and improve efficiency; (3) providing a feedback loop operable at a sufficiently high frequency so that flicker is prevented when changing the demand at high levels of brightness; and (4) varying the modulation of the filament supply so as to prevent beat frequencies with the pulsating arc current.

These and other features will be explained upon examination of the following description.

DETAILED DESCRIPTION OF THE PREFERRED EMBODIMENTS

Figure 1:
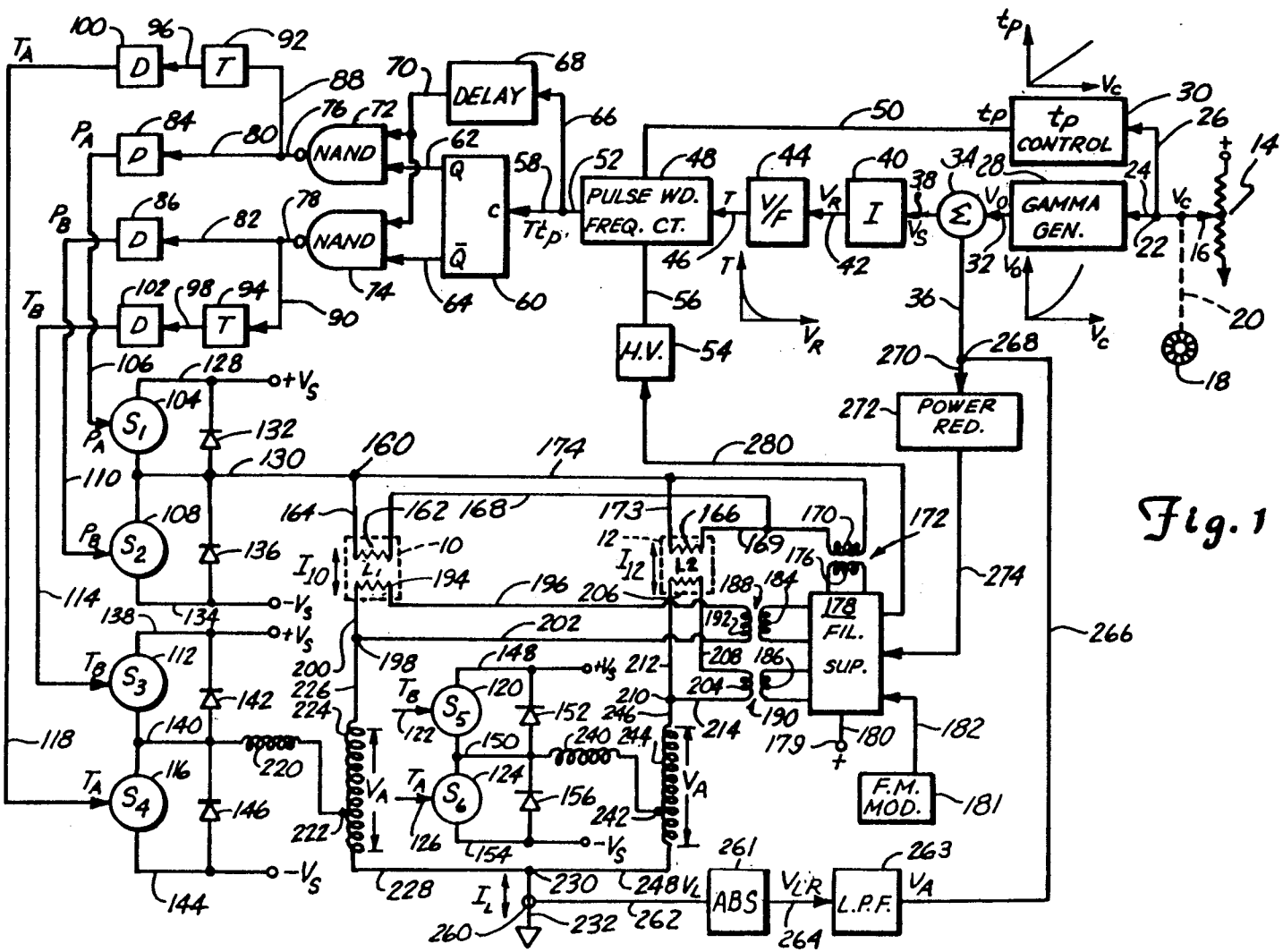
FIG. 1 shows a block circuit diagram of the present invention.

FIG. 1 shows a pair of fluorescent lamps L1 and L2, identified by reference numerals 10 and 12, respectively, whose luminence is to be changed in accordance with dimming commands provided by an operator. While I have shown two fluorescent lamps, it is to be understood that the present invention is equally applicable to a single lamp or to three or more lamps, respectively. In the preferred embodiment, lamps 10 and 12 are intended for use as back lighting for aircraft flat panel displays, although it should be realized that the present invention can also be employed in many other environments including general area lighting. When used as back lighting for aircraft instrument displays, it has been found necessary that the luminescence of the lamps be varied in a ratio greater than 2,000:1 for commercial aircraft and up to 10,000:1 for miliatary aircraft in order to meet the tolerances required in view of the changes in ambient light that occur. To give the pilot control over the luminescence of lamps 10 and 12, a potentiometer winding 14 is connected between a positive source of voltage and signal ground. Winding 14 is shown having a wiper 16, the position of which is controlled by the pilot utilizing a knob 18, for example, through a mechanical connection shown as dashed line 20. The voltage across the winding of potentiometer 14 may be, for example, 10 V DC so that a voltage, $V_C$, variable between zero and +10 volts is presented on wiper 16. Voltage $V_C$ is presented by way of a conductor 22 and conductors 24 and 26 to the inputs of a gamma generator 28 and a pulse width control circuit, "$t_p$ control", 30, respectively.

Gamma generator 28 operates on the $V_C$ voltage at its input to produce a voltage $V_O$ output which varies with $V_C$ in a cubic fashion, as is shown in the small graph drawn just below gamma generator 28. By varying $V_O$, the response of the system is made to vary approximately with the log of the input, as is desired, so that small changes at low light levels and large changes at high light levels occur as explained above. Gamma generators operable in a cubic fashion are known in the art.

The voltage $V_O$ from gamma generator 28 is presented by way of a conductor 32 to a summing circuit 34 which also receives a rebalance voltage on a conductor 36 from a source which will be described hereinafter. Summing circuit 34 subtracts the two inputs and, if a difference in the magnitude of the signals on conductors 32 and 36 exists, summing circuit 34 will produce an output voltage $V_S$ indicative thereof on a conductor 38 which presents $V_S$ to an integrator 40. Integrator 40 integrates the signal on conductor 38 to produce an output voltage $V_R$ on a conductor 42 which will increase or decrease depending on the sign of the signal on conductor 38 until such time as the input signals on conductors 32 and 36 are equal, and thereafter $V_R$ will remain constant until a further unbalance occurs at summing circuit 34.

Conductor 42 provides an input to a voltage to frequency converter 44 which operates to produce an output signal of frequency which varies linearly with the magnitude of the signal $V_R$ on conductor 42. Since, however, the frequency of the signal is proportional to 1/T, where T is the period of the signal, the output of converter 44 is shown to be a signal T on a conductor 46 which varies inversely with $V_R$, as seen in the small graph drawn just below converter 44.

The signal T on conductor 46 is presented to a pulse width and frequency control circuit 48 which also receives a pulse width input, $t_p$, from the pulse width control 30 by way of a conductor 50. Pulse width signal, $t_p$ varies linearly with $V_C$ as seen on the small graph drawn just above $t_p$ control 30. Pulse width and frequency control 30 operates to produce a series of output pulses on a conductor 52 wherein each pulse has a pulse width, $t_p$, and the pulse series has a frequency 1/T. Pulse width and frequency control circuit 48 also receives a signal from a high voltage control circuit 54 over a conductor 56 which is used to delay an output on conductor 52 until the lamp filaments have reached operating temperature, since premature application of a high voltage would cause damage to the lamps 10 and 12. This delay is believed to be the major reason why, in the present invention, cathode sputtering has been minimized so as to allow the circuit to obtain over 25,000 one-minute on and one-minute off start-stop cycles with negligible cathode damage. This feature will be described more fully hereinafter.

When the pulse width and frequency control circuit 48 starts operating, the signal $Tt_p$ on conductor 52 is presented by a conductor 58 to the input C of a flip-flop 60 which has Q and $\overline{Q}$ outputs 62 and 64, respectively. The signal on conductor 52 is also presented via a conductor 66 to a delay circuit 68 having an output on a conductor 70. Delay circuit 68 exists because the flip-flop 60 inherently has a small delay between the occurrance of an input at input C and the occurrance of outputs at output Q and $\overline{Q}$, respectively. The delay from delay circuit 68 is chosen to be just sufficient to compensate for the delay in flip-flop 60 and, accordingly, the output on conductor 70 is a replica of the output on conductor 52 but delayed by the same delay as occurs in flip-flop 60.

The Q output on line 62 of flip-flop 60 is presented to the lower input terminal of a first NAND gate 72 while the $\overline{Q}$ output on conductor 64 is presented to the lower input of a second NAND gate 74. The upper input of NAND gates 72 and 74 are both connected to conductor 70 and receive the delayed $Tt_p$ signal. Flip-flop 60 operates to produce "1" and "0" signals at its outputs 62 and 64 in an opposite sense. More particularly, by referring to FIG. 2, graph A shows the delayed signal $Tt_p$ while graphs B and C show the outputs Q and Q, respectively, wherein the higher signals are considered to be "1's" while the lower signals are considered to be "0's". NAND gates 72 and 74 operate on the "1" and "0" signals received at their inputs to produce outputs on conductors 76 and 78, respectively. Since a NAND gate operates to produce a "1" output only when its inputs are both "1's", the outputs on lines 76 and 78 will be like those shown on graphs D and E of FIG. 2. It should be noted that the period T' in graphs D and E are equal to twice the period T of the $Tt_p$ signal in graph A and that the signals from NAND gates 72 and 74 are 180° out of phase.

Figure 2:
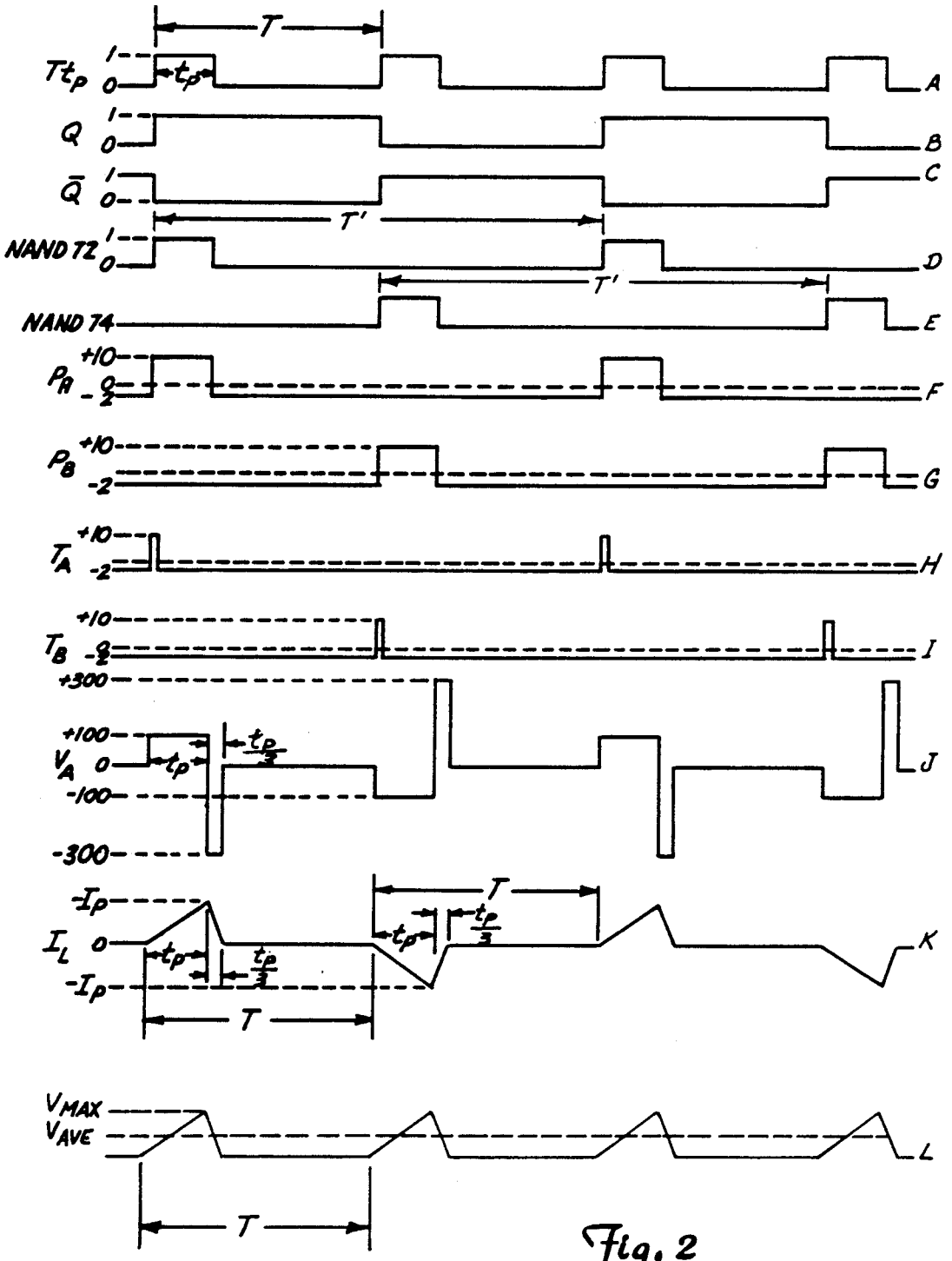
FIG. 2 is a series of related graphs showing the signals present at various positions in the apparatus of FIG. 1.

The signals from NAND gates 72 and 74 having the shapes shown in graphs D and E of FIG. 2 appear at outputs 76 and 78 of FIG. 1, respectively, and are presented by way of conductors 80 and 82 to a pair of driver circuits 84 and 86, respectively, and also by way of conductors 88 and 90 to a pair of trigger generator circuits 92 and 94, respectively. Trigger generator circuits 92 and 94 operate upon the receipt of a leading edge of the signal from NAND gates 72 and 74 to produce a short duration pulse on output conductors 96 and 98, respectively, to a second pair of driver circuits 100 and 102, respectively. The output of driver circuit 84 is a phase A signal, "$P_A$", which is presented to a first switch 104 by way of a conductor 106, and the output of driver circuit 86 is a phase B signal, "$P_B$", which is presented to a second switch 108 by way of a conductor 110. The output of driver circuit 102 is a trigger B signal, "$T_B$", which is presented to a third switch 112 by way of a conductor 114, and the output of driver circuit 100 is a trigger A signal, "$T_A$", which is presented to a fourth switch 116 by way of a conductor 118.

When more than one fluorescent lamp is to be used, the trigger signals $T_A$ and $T_B$ will also be presented to further switches. For example, in FIG. 1, because two fluorescent lamps are shown, the signal $T_B$ is also presented to a fifth switch 120 by a conductor 122 and the signal $T_A$ is presented to a sixth switch 124 by a conductor 126. Although not shown, conductors 122 and 126 are connected to drivers 102 and 100, respectively, in the same manner as conductors 114 and 118.

While other types of switches may be employed, in the Preferred embodiments, switches 104, 108, 112, 116, 120 and 124 are field-effect transistors and the signals $P_A$, $P_B$, $T_A$ and $T_B$ are applied to the gates thereof. The field-effect transistors used in the preferred embodiment require a positive gate to source voltage of about 10 V to turn the switches on and about a −2 V to turn the switches off. .It will be understood that the specific kind of switches used will dictate the requirements for turning them on and off, and the +10 to −2 V used herein is a matter of design choice.

Driver circuits 84, 86, 100 and 102 are voltage converters which operate on the signals from NAND gates 72 and 74 to produce voltages which vary between +10 and −2 V but with the wave shape which appears at their inputs. More particularly, the shape of the signal "$P_A$" will appear as is shown in graph F on FIG. 2 which, it is seen, is like the output of NAND gate 72 in graph D but which varies from a +10 to a −2 V. Similarly, the output "$P_B$" from driver 86 will appear as is shown in graph G and is like the output of NAND gate 74 in graph E but varying between a +10 and a −2 V. The output $T_A$ from driver 100 will appear as is shown in graph H and comprises a short pulse width signal similar to that produced by the trigger generator 92 but which varies between +10 and −2 V starting at the leading edge of the signal from NAND gate 72. Similarly, the output $T_B$ from driver 102 is a short pulse width signal such as is seen in graph I of FIG. 2 and is the same as the output of trigger generator 94 but which varies between +10 and −2 V starting with the leading edge of the output of NAND gate 74.

As will be explained in greater detail hereinafter, the width of the pulses for the $P_A$ and $P_B$ signals varies from approximately 1 microsecond to approximately 25 microseconds in the preferred embodiment. Simultaneously an independently, the pulse frequency (period) varies from 100 Hz to 16,000 Hz. The width is dependent on the output of the pulse width and frequency control circuit 48 as governed by the pulse width control circuit 30. The pulse width of the $T_A$ and $T_B$ signals is fixed at approximately 1 microsecond. As will also be explained in greater detail hereinafter, the very short pulse width of signals $T_A$ and $T_B$ are used to produce a very high voltage across the lamps 10 and 12 for a very short time duration in order to provide a lamp ignition voltage to start arc current flowing in the lamps. The longer and variable pulse widths provided by the $P_A$ and $P_B$ signals continue the arc current flowing after ignition in variable amounts to provide the desired dimming.

Switch 104 with its gate terminal connected to receive signal $P_A$ has its drain terminal connected to a source of comparatively large positive voltage "$+V_S$" by a conductor 128 and has its source terminal connected to a conductor 130. A diode 132 is shown connected between the source and drain terminals of switch 104 and is poled so as to conduct current from conductor 130 to conductor 128. In similar fashion, switch 108, having its gate terminal connected to receive signal $P_B$, has its drain terminal connected to conductor 130 and has its source terminal connected to a source of comparatively large negative voltage "$-V_S$" by a conductor 134. A second diode 136 is connected across the source and drain terminals of switch 108 and is poled so as to conduct current from conductor 134 to conductor 130. Switch 112, having its gate terminal connected to receive signal $T_B$, has its drain terminal connected to the source of positive voltage "$+V_S$" by a conductor 138 and has its source terminal connected to a conductor 140. A third diode 142 is connected across the source and drain terminals of switch 112 and is poled so as to conduct current from conductor 140 to conductor 138. Similarly, switch 116, having its gate terminal connected to receive signal $T_A$, has its drain terminal connected to conductor 140 and has its source terminal connected to the source of negative voltage "$-V_S$" by a conductor 144. A fourth diode 146 is connected across the gate and source terminals of switch 116 and is poled to conduct current from conductor 144 to conductor 140. When more than one lamp is employed, as is the case in FIG. 1, switch 120, having its gate terminal connected to receive the signal $T_B$, has its drain terminal connected to the source of positive voltage "$+V_S$" by a conductor 148 and its source terminal connected to a conductor 150. A fifth diode 152 is connected across the source and drain terminals of switch 120 and is poled so as to conduct current from conductor 150 to conductor 148. Similarly, switch 124, having its gate connected to receive the signal $T_A$, has its drain terminal connected to conductor 150 and has its source terminal connected to the source of negative voltage "$-V_S$" by a conductor 154. A sixth diode 156 is shown connected across the source and drain terminals of switch 124 and is poled so as to conduct current from conductor 154 to conductor 150. If other lamps are employed, the switches associated with them will be connected in a similar fashion.

It will be observed that when a $P_A$ pulse occurs, switch 104 closes and the positive voltage $+V_S$ is connected to conductor 130 therethrough. This voltage remains on conductor 130 until the end of the pulse at which time switch 104 will be opened. Similarly, when a pulse $P_B$ occurs, switch 108 closes and the negative voltage $-V_S$ is connected to conductor 130 therethrough. This voltage remains on conductor 130 for the duration of the pulse after which time the switch 108 will open. In similar fashion, the positive and negative voltages $+V_S$ and $-V_S$ will be supplied through switches 112 and 116 and 120 and 124 to conductors 140 and 150 upon the occurrance of signals $T_B$ and $T_A$ but for a much shorter duration of time after which the switches 112 and 116 will open.

Conductor 130 is shown connected to a terminal 160. Terminal 160 is connected to one end of a filament 162 of lamp 10 by a conductor 164 and the other end of filament 162 is connected to one end of a filament 166 of lamp 12 by a conductor 168 and a conductor 169. The other end of filament 166 is connected by a conductor 168 to one end of secondary winding 170 of a transformer 172. The other end of secondary winding 170 is connected to the other end of filament 166 by a conductor 173 and to junction 160 by a conductor 174. A primary winding 176 of transformer 172 is connected to a filament supply circuit 178 which is shown receiving power from an input supply 179 by a conductor 180 and is modulated by a wide band FM modulator 181, to be discussed hereinafter, by a conductor 182. Filament supply 178 is also connected to the primary windings 184 and 186 of transformers 188 and 190, respectively. The upper end of a secondary winding 192 of transformer 188 is connected to one end of a second filament 194 of lamp 10 by a conductor 196. The other end of filament 194 is connected to a junction point 198 by a conductor 200 and junction point 198 is connected to the lower end of secondary winding 192 by a conductor 202. Similarly, the upPer end of a secondary winding 204 of transformer 190 is connected to one end of a second filament 206 of lamp 12 by a conductor 208. The other end of filament 206 is connected to a junction point 210 by a conductor 212 and junction point 210 is connected to the lower end of secondary winding 204 by a conductor 214. The purpose of transformers 172, 188 and 190 is to provide current to heat the filaments of the fluorescent lamps 10 and 12 at least until such time that the arc current shown beside the lamps 10 and 12 as "$I_{10}$" and "$I_{12}$" is sufficiently great to maintain the filaments at the desired temperature without the filament supply. The description of a circuit for controlling the filament supply current in accordance with the magnitude of the arc current will be described hereinafter.

Figure 3:
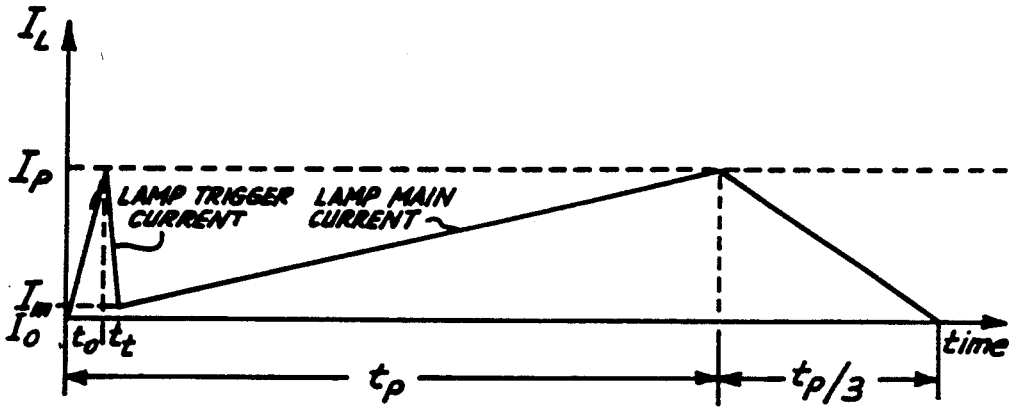
FIG. 3 is an enlarged view of the lamp arc current waveform.

Conductor 140 attached to switches 112 and 116 is connected through a choke inductance 220 to a tap 222 located about a quarter of the way up an autotransformer winding 224. The top of autotransformer winding 224 is connected to junction point 198 by a conductor 226 and the bottom of autotransformer winding 224 is connected by a conductor 228 to a junction point 230 shown connected to signal ground by a conductor 232. In similar fashion, conductor 150 attached to switches 120 and 124 is connected through a choke inductance 240 to a tap 242 located about a quarter of the way up an autotransformer winding 244 The top of autotransformer winding 244 is connected to junction point 210 by a conductor 246 and the bottom of autotransformer winding 244 is connected by a conductor 248 to junction 230. The purpose of autotransformer windings 224 and 244 is to provide a controlled trigger current build-up and decay while providing a high energy voltage across lamps 10 and 12 during the ignition portion of the cycle to ionize the mercury atoms to start the plasma arc, even at low luminance settings. It also provides lamp to lamp luminance balance, isolates the lamps so that failure of one lamp will not affect the other, and eliminates luminance standing waves and swirls. Use of an autotransformer instead of a transformer or inductive ballast reduces the size of the magnetics, and provides, in the present case, a voltage step-up at points 198 and 210 which is about four times as great as the voltage at taps 222 and 242, respectively. Accordingly, when, for example, a pulse appears in signal $P_A$ which operates to turn switch 104 on and thus apply a positive voltage $+V_S$ which, in the preferred embodiment, is around 200 V, to junction point 160, a short duration pulse appears in signal $T_A$ turning on switches 116 and 124, and thereby applying a $-V_S$ of about $-200$ V to conductors 140 and 150 and junction points 222 and 242 Thus, a signal of magnitude about $-800$ V will briefly appear at junction points 198 and 210, and thus at the bottom filaments 194 and 206, at the same time that a $+200$ V appears at junction point 160 and thus at the top filaments 162 and 166. Therefore, an approximately 1,000 V difference exists between the two filaments in lamps 10 and 12 for the short duration of $T_A$ which is sufficient to ignite the lamps and start the currents $I_{1O}$ and $I_{12}$ flowing. This can be better seen on the left-hand portion of FIG. 3 where at the time $t_O$, when the large voltage is impressed across the lamps, the lamp arc current begins increasing rather steeply up to a value $I_P$ which occurs after the short duration pulse time $t_t$ which is chosen in the preferred embodiment to be about 1 microsecond. After the trigger pulse disappears, the current through the inductors falls off but continues to a point $I_M$. Point $I_M$ is where the main arc current $I_{1O}$ and $I_{12}$ have risen because of the pulse of PA which usually lasts longer (in the preferred embodiment up to 25 microseconds) than the short (1 microsecond) duration trigger pulse. The arc current then continues rising, as seen in FIG. 3, until such time as the pulse from $P_A$ current ceases after a time $t_p$ which, as mentioned, may be as great as 25 microseconds. Switch S1 then opens and the $+200$ volt $V_S$ supply is removed from junction point 160 and the arc currents $I_{1O}$ and $I_{12}$ decay through diode 136 because of the residual charge left in the transformer windings 224 and 244 until it again reaches zero at a time equivalent to $t_p$ divided by 3. Although not shown in FIG. 3, there is a "ringing" of the current as it reaches the zero axis because of disributed capacitance in the autotransfommers, which provides a self-resonant frequency. This resonance causes the current to over-shoot the zero axis and to "ring" to the zero value in a manner to be described in connection with FIG. 4. The reason for the buildup and decay of lamp main current as shown in FIG. 3 can best be understood by consideration of graphs J and K in FIG. 2. Graph J shows the voltage $V_A$ occurring across the transformer windings 224 and 244 due to the operation of switches S1 and S2 and not taking into consideration the ignition voltage of very short duration which occurs from the operation of switches S4 and S6.

It is seen that upon closing of switch S1, a $+200$ V is applied to junction point 160 and, if it is assumed that the voltage drop across lamps 10 and 12 is approximately 100 V each, then the voltage at junction points 198 and 210 is approximately 100 V with respect to signal ground. In other words, the voltage across autotransformer windings 224 and 244 will be 100 V for the duration of the closing of switch S1 which, as previously indicated, is a time $t_p$ which may vary from 1 microsecond to about 25 microseconds in the preferred embodiment When switch S1 thereafter opens, the voltage across autotransformer windings 224 and 244 drops to approximately $-300$ V due to the energy stored in the inductances because junction point 160 is clamped at the $-V_S$ voltage by diode 136 and because the lamp voltage is still 100 V due to current flowing in the same direction. Since the voltage is across an inductor, the volt/time area during the charging which occurred for a time $t_p$ must equal the volt/time area during the discharge and, accordingly, the time to discharge the voltage across autotransformer windings 224 and 244 will, in the present example, be $t_p$ divided by 3. After this time, the energy is spent and the voltage returns to zero. Later, when a pulse occurs in the signal $P_B$ switch S2 will be closed and a −200 V will be applied therethrough to junction point 160. Again ignoring the ignition voltages occurring because of the closure of switches S3 and S5, and again assuming a 100 V drop (now of opposite polarity) across lamps 10 and 12, the voltage at junction points 198 and 210 will now be a −100 V and current will flow from the signal ground through the autotransformer winding 224 and in the opposite direction across lamps 10 and 12. At the end of the pulse from the signal $P_B$, switch S2 will again open and the voltage at junction point 160 will rise to a +200 V where diode 132 conducts. Similar to the example above, junction point 160 is clamped at the $+V_S$ voltage by diode 132 because the lamp voltage is still 100 V due to current flowing in the same direction (opposite to the direction in the example above). Here again, however, the voltage across transformer windings 224 and 244 will become a +300 V for a time $t_p$ divided by 3 and will thereafter dissipate to zero Accordingly, the current passing through the transformer windings 224 and 244, which is the same as the arc current passing through lamps 10 and 12, will build up according to the curve shown in graph K as the phase A and phase B signals turn switches 104 and 108 on add off. It should be remembered, however, that FIG. 3 is a more accurate representation of the way the current changes since it takes into consideration the initial ignition current produced by the operation of switches S4 and S6.

The value of choke inductances 220 and 240 is chosen to be such that the current allowed through transformer windings 224 and 244 does not go above the level $I_P$ in FIG. 3. It should also be noted that any excess energy stored in choke inductances 220 and 240 will be returned to the supply through diodes 142, 146, 152 and 156 so as to be reused on the next half cycles Likewise, the diodes provide overvoltage protection for the field-effect transistors and, accordingly, the trigger circuit not only provides high voltage for lamp reignition with controlled lamp trigger current peaks, but does it without loss elements such as resistors. This provides considerably improved circuit efficiency.

Figure 4:
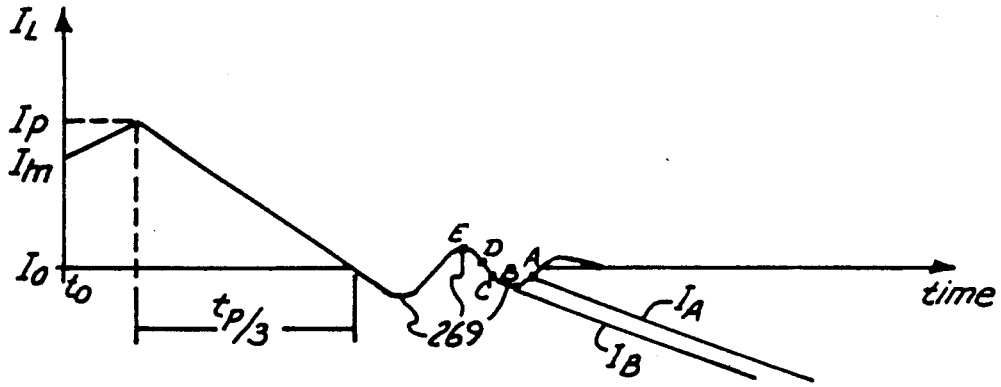
FIG. 4 is a redrawing of a portion of FIG. 3 showing a ringing effect at the end of a cycle.

The total current $I_L$ consisting of the currents $I_{1O}$ and $I_{12}$ passing through lamps 10 and 12 is sensed as it travels along conductor 232 to signal ground by a transformer winding 260. A voltage $V_L$ produced by winding 260 is presented to a precision absolute value circuit 261 so as to produce a rectified voltage, $V_{LR}$, having a shape like that shown in graph L of FIG. 2, which is seen to be like the current shape of graph K but with the peaks all positive. This $V_{LR}$ signal is then presented to a low pass filter 263 by a conductor 264 to produce a DC output signal $V_A$ whose magnitude is controlled by the time average value of the voltage $V_{LR}$. The averaged voltage, $V_A$, is presented by a conductor 266 to a junction point 268 connected to conductor 36 providing the negative feedback input to summation circuit 34. Accordingly, as the frequency changes with the output of voltage to frequency converter 44, the output from pulse width and frequency control 48 will increase the frequency of the signal, and thus decrease the period of the signal, thereby increasing the energy applied to junction point 160 and thereby increasing the current $I_{1O}$ and $I_{12}$ and thus $I_L$. When this current has reached a value whereby the negative signal $V_A$ on line 266 and conductor 36 is equal to the positive signal $V_O$ produced by gamma generator 28, the T signal from voltage to frequency converter 44 will stop changing and a balanced situation exists The feedback loop actually achieves a second purpose as will now be explained in connection with FIG. 4. In FIG. 4, the last part of the graph of FIG. 3 is redrawn for the period $t_p$ divided by 3 and shortly thereafter. It is seen that the trailing edge of the current does not stop when it reaches $I_o$ but, because of inherent capacitances in the autotransformer windings 224 and 244, over-shoots and starts a "ringing" which after a short time damps out to a zero value but which, in doing so, creates several bumps in the waveform such as those identified by reference numeral 269. When operating at low intensities, i.e. when the period T is large (see graph K of FIG. 2), the beginning of the next current ramp will occur after the "ringing" aas damped out and the bumps 269 are gone. However, under high luminance conditions, the period T becomes smaller and the next current ramp may start before the "ringing" has completely damped out The result is that the next current ramp may start on a bump such as at A and proceed along a line such as shown by ramp $I_A$ in FIG. 4. This will still present no problem if the operator is not changing the input $V_C$ by moving wiper 16 on winding 14 of FIG. 1. However, if the operator moves knob 18 to slowly increase $V_C$, the ramp IA will move to position $I_B$, and then through ramps starting at C, D and E (not shown) so that the beginning of the next current ramp follows the bumps 269 to the left in FIG. 4. The result is that the rebalance signal varies up and down so that a fluctuating signal to lamps 10 and 12 is produced and a flickering of the lamps will become apparent.

The solution to this problem is to set the parameters of the system such that the feedback signal is accomplished at a rate which is high enough, e.g. 750 Hz, so that the human eye cannot see the flicker that results. For example, increasing the overall gain of the loop from the sum circuit through the lamp back to the sum circuit until the speed of response of the loop is above 750 Hz, the eye cannot see the flicker.

As was mentioned above, it is desirable to reduce the filament supply power and conserve energy when the arc currents $I_{1O}$ and $I_{12}$ are large enough to take over some or all of the heating. Accordingly, the output from the low pass filter 263 to junction point 268 is also presented by way of a conductor 270 to a power reduction circuit 272 which provides an output on a conductor 274 to the filament supply circuit 178. Since the magnitude of this signal is related to the total current $I_L$, it is thus also related to $I_{1O}$ and $I_{12}$ so that as this current $I_L$ increases the amount of power necessary to be supplied by the filament supply 178 to the filaments is decreased. In the maximum condition where the arc current $I_L$ is greatest, the filament supply may be shut off entirely and no energy is necessary for it to heat the filaments of lamps 10 and 12 thereby saving power and provide greatly increased efficiency.

The filaments of lamps 10 and 12 are typical tungsten filament heater elements dip-coated with barium oxide which is quite fragile. When these filaments are cold, a large inrush of current causing a rapid rise in temperature can cause the fragile barium oxide to be thermally shocked by the violent temperature rise and produce some oxide flaking off at each start. This is prevented in the present invention by sensing the filament temperature in a unique fashion and by limiting the heater current that is available when the filaments are cold. When the filaments are cold, a signal from the filament supply 178 through a conductor 280 to the high voltage supply circuit 54 operates to prevent the pulse width and frequency control 148 from increasing the pulse width and decreasing the frequency, as would occur during a setting of potentiometer wiper 16 to a position calling for a very bright fluorescent light, until the filaments have had a chance to warm up in a relatively slow manner In other words, the present invention limits the current available when the filaments are cold and thus lowers the stress during lamp start-up. The temperature of the filaments is sensed in the present invention by sensing the filament voltage in the filament supply 172 at a constant limited current Since the value of the impedance of the lamps is very low when the filaments are cold, the starting current, if not limited, would be very high. However, by limiting the current, the voltage will vary with the temperature of the filaments starting low and becoming greater as the filaments warm up. When the voltage finally reaches the value near its rated voltage, the temperature of the filaments is near its normal operating level and a signal to the high voltage source 54 will now enable it for normal operation. Of course, the time necessary for this will vary with the ambient temperature of the filaments at the start and may be from several seconds to several minutes Once reached, an additional second of time may be provided to assure the stabilization of the temperature as its rated value and then to enable circuit 48 and provide the HV pulses to the lamps.

Because the frequency generated by the phase A and phase B signals changes as the signal calling for greater or lesser dimming is produced, a beat frequency may develop between the frequency called for and the frequency supplied by the filament supply 178. This can cause flicker in the lamps 10 and 12, but is avoided in the present invention by the use of the wide band FM modulator circuit 250 which operates to frequency modulate the constant frequency power supply from filament supply 178 By utilizing a wide band FM modulation instead of a narrow band FM, the eye will not perceive any flicker because the two oscillators can never be harmonically related long enough to have any visible flicker The wide band FM lowers the energy level in each of the sidebands of the beat frequencies and spreads this energy out over many more sideband frequencies and thus the beats are undetectable to the eye. This invention is described in more detail and claimed in a co-pending application Serial No. 07/280,493, entitled "Reduction of the Effects of Beat Frequencies in Systems with Multiple Oscillators," filed by the present inventor on even date herewith, and assigned to the assignee of the present invention.

It is therefore seen that I have provided a fluorescent lamp dimmer which can be effectively used in cases where very large ratios of luminescence are required and which does so in such a way as to increase the efficiency and eliminate instabilities found in prior art devices Although the present invention has been described with reference to preferred embodiments, workers skilled in the art will recognize that changes may be made in form and detail without departing from the spirit and scope of the invention.

What is claimed is:

1. Apparatus for dimming a fluorescent lamp comprising:

energy producing means for producing a first voltage with a pulse width parameter $t_p$ and with a period parameter T;

shaping means connected to the energy producing means to receive the first voltage and operable to alter at least one of the parameters in accordance with a desired amount of dimming to produce an altered voltage; and first connection means for connecting the shaping means to the fluorescent lamp to apply the altered voltage thereto, the altered voltage operable to cause an arc current I in the lamp of magnitude which varies with $t_p2$ divided by T.

2. Apparatus according to claim 1 further including control means for producing a control voltage of magnitude indicative of the desired amount of dimming and means connecting the control means to the shaping means to provide the control voltage thereto, the shaping means altering the first voltage in accordance with the magnitude of the control voltage.

3. Apparatus according to claim 1 wherein the shaping means includes pulse width control means and period control means, and the shaping means is operable to alter both $t_p$ and T.

4. Apparatus according to claim 1 wherein the shaping means further includes trigger means operable to provide a trigger pulse starting substantially simultaneously with the pulse of width $t_p$ but having a trigger pulse width generally less than $t_p$; and second connection means for connecting the trigger means to the fluorescent lamp to apply the trigger pulse thereto, the trigger pulse operable to cause the arc current to flow during an initial part of the pulse width $t_p$.

5. Apparatus according to claim 1 wherein the first connection means includes (1) a source of first voltage of magnitude sufficient to maintain an arc current in the lamp and (2) a first switch operable to "on" and "off" conditions by the pulses in the altered voltage, in the "on" condition, the first switch operable to connect the fluorescent lamp to the source of first voltage and in the "off" condition to remove the source of first voltage from the fluorescent lamp.

6. Apparatus according to claim 5 wherein the shaping means further includes trigger means operable to provide a trigger pulse starting substantially simultaneously with the pulse of width $t_p$ but having a trigger pulse width generally less than $t_p$, second connection means for connecting the trigger means to the fluorescent lamp to apply the trigger pulse thereto, the trigger pulse operable to cause the arc current to flow during an initial part of the pulse width $t_p$, and wherein the second connection means includes (1) a source of second voltage of magnitude sufficient to start the arc current flowing, and (2) a second switch operable to "on" and "off" conditions by trigger pulses from the trigger means, in the "on" condition the second switch operable to connect the fluorescent lamp to the source of second voltage and in the "off" condition operable to remove the source of second voltage from the fluorescent lamp.

7. Apparatus according to claim 6 wherein the fluorescent lamp has first and second filaments each having first and second ends and the first switch, when "on", operates to connect the first end of the first filament to the source of first voltage and the second switch, when "on", operates to connect the first end of the second filament to the source of second voltage.

8. Apparatus according to claim 7 wherein the sources of first and second voltage include first and second DC supplies of opposite polarity and wherein the source of second voltage includes an autotransformer with a tap connected to the second DC supply when the second switch is "on".

9. Apparatus according to claim 8 further including first unidirectional current conducting means connected across the first switch and poled to conduct current in a direction opposite the direction of current flow through the first switch and second unidirectional current conducting means connected across the second switch and poled to conduct current in a direction opposite to the direction of current flow through the second switch.

10. Apparatus according to claim 9 wherein the source of second voltage further includes a choke inductance connected between the tap of the autotransformer and the second switch.

11. Apparatus according to claim 10 further including filament supply means having a first output connected between the first and second ends of the first filament and a second output connected between the first and second ends of the second filament, the first and second outputs being operable to heat the filaments to a desired temperature.

12. Apparatus according to claim 11 including third connection means connecting the filament supply source to the energy producing means to inhibit the voltage therefrom until the first and second filaments have reached the desired temperature.

13. Apparatus according to claim 12 wherein the filament supply means senses the temperature of the first and second filaments by limiting the current in the first and second outputs and by measuring the voltage rise at the first and second outputs, and producing an inhibit signal to the energy producing means until the voltage sensed is at a predetermined high level.

14. Apparatus according to claim 10 further including current sensing means for sensing the arc current in the fluorescent lamp and producing a rebalance output in accordance therewith and means connecting the sensing means to the energy producing means to subtract the rebalance voltage from the first voltage so that the parameters $t_p$ and T are not further altered by the shaping means.

15. Apparatus according to claim 11 further including current sensing means for sensing the arc current in the fluorescent lamp and producing a rebalance output in accordance therewith and means connecting the sensing means to the energy producing means to subtract the rebalance voltage from the first voltage so that the parameters $t_p$ and T are not further altered by the shaping means and further including power reduction means connected to the current sensing means and to the filament supply means and operable to reduce the first and second outputs as the rebalance signal increases.

16. Apparatus according to claim 11 further including FM modulation means connected to the filament supply means to frequency modulate the first and second outputs.

17. Apparatus according to claim 14 further including FM modulation means connected to the filament supply means to frequency modulate the first and second outputs.

18. Apparatus according to claim 14 wherein the response time of the feedback is high enough to prevent variable flicker of the fluorescent lamp at high intensities.

19. Dimming apparatus for use with a fluorescent lamp comprising:

voltage supply means for producing a first signal having a plurality of pulses of variable pulse width $t_p$ and spaced a variable period T apart, $t_p$ and T being chosen in accordance with a desired amount of dimming; and switch means connected to the voltage supply means to receive the first signal, the switch means being operated to "on" and "off" conditions by the presence and absence of pulses in the first signal, the switch means operating to apply a first predetermined voltage to the fluorescent lamp during times corresponding to $t_p$ and at a frequency determined by T.

20. Apparatus according to claim 19 wherein the voltage supply means produces a second signal having the plurality of pulses of fixed pulse width generally less than $t_p$ and spaced at the variable period T apart, the leading edge of each pulse of fixed pulse width corresponding substantially to the leading edge of each pulse width of variable pulse width, and the switch means being operated to "on" and "off" conditions by the presence and absence of pulses of fixed pulse width for applying a second predetermined voltage to the fluorescent lamp during times corresponding to the fixed pulse width and at the frequency determined by T.

21. Apparatus according to claim 20 wherein the fluorescent lamp includes first and second filaments each having first and second end terminals and the switch means connects the first predetermined voltage to the first end terminal of the first filament and connects the second predetermined voltage to the first end terminal of the second filament 22. Apparatus according to claim 21 further including filament supply means having a first output connected across the first and second and terminals of the first filament and a second output connected across the first and second end terminals of the second filament, the first and second outputs energizing the first and second filaments to an operating condition.

23. Apparatus according to claim 22 further including current sensing means connected to the fluorescent lamp to produce a flow signal indicative of the current flowing between the first and second filaments, and means connecting the current sensing means to the filament supply means to vary the first and second outputs inversely with the flow signal.

24. Apparatus according to claim 21 wherein the first and second predetermined voltages are of opposite polarity so as to increase the voltage difference between the first end terminals of the first and second filaments during the fixed pulse width.

25. Apparatus according to claim 24 wherein the second predetermined voltage is several times greater than the first predetermined voltage.

26. Apparatus according to claim 25 further including an autotransformer having a tap connected to a negative potential and having first and second end windings, the first end winding connected to the first end terminal of the second filament and the second end winding connected to a source of reference potential of magnitude substantially midway between the positive and negative voltages.

27. Apparatus according to claim 23 further including a first voltage source of positive polarity to provide the first predetermined voltage and a second voltage source of negative polarity connected to a tap of an autotransformer having first and second end windings, the first end winding being connected to the first end terminal of the second filament and the second end winding being connected to a reference voltage of magnitude substantially midway between the positive and negative voltages, the magnitude of the signal on the first end terminal of the second filament being several times greater than the magnitude of the voltage on the first end terminal of the first filament so as to increase the voltage difference between the first end terminals of the first and second filaments during the fixed pulse width.

28. Apparatus for use with a fluorescent lamp which is energized by a pulsed voltage of pulse width $t_p$ and period T comprising:

means for varying $t_p$, and means for varying T whereby the luminance L of the lamp is varied in proportion to $t_p$ 2 divided by T so as to produce large changes of L for small changes of $t_p$ and T.

29. Apparatus according to claim 28 wherein the means for varying $t_p$ and T are arranged to produce outputs which vary by ratios of about 25 to 1 so as to obtain variations of L of about 15,625 to 1 and greater.

30. Apparatus according to claim 29 wherein the fluorescent lamp impedance is negative and the luminance thereof is inversely proportional to Z $$\left[ L = \frac{t_p^2}{TZ} \right]$$

where Z is the impedance of the lamp, and accordingly, increases of L are accompanied by decreases in Z so that variations of $t_p$ and T produce a variation of L of greater than 15,625 to 1.

31. Apparatus according to claim 30 wherein the means for varying T includes a voltage producing means for receiving an input of a magnitude which varies in accordance with the desired dimming, and transmitting voltage which varies substantially with the log of the input.

32. The method of controlling the dimming of a fluorescent lamp by relatively large amounts using relatively small changes in parameters comprising the steps of:

(1) providing a pulsed input signal having parameters $t_p$ and T where $t_p$ is the width of pulses in the signal and T is the period between pulses in the signal;

(2) applying the input signal to the fluorescent lamp so that the luminescence varies with $t_p$2 divided by T; and (3) varying the parameters of $t_p$ and T in accordance with the desired dimming.

33. The method of claim 32 wherein the parameters $t_p$ and T are varied in a ratio of substantially 1 to 25 and the luminance varies according to $t_p$2 divided by T to provide a variation in luminance in a ratio of substantially 15,625 to 1.

* * * * *

UNITED STATES PATENT AND TRADEMARK OFFICE

CERTIFICATE OF CORRECTION

PATENT NO. : 4,998,045

DATED : March 5, 1991

INVENTOR(S) : Joseph H. Ruby

It is certified that error appears in the above-identified patent and that said Letters Patent is hereby corrected as shown below:

Col. 14, line 36, after "filament", insert --.--.

Col. 14, line 39, delete "and", insert --end--.

Signed and Sealed this

Fourteenth Day of July, 1992

*Attest:*

DOUGLAS B. COMER

*Attesting Officer*

*Acting Commissioner of Patents and Trademarks*